US010396485B1

(12) United States Patent
Smoll et al.

(10) Patent No.: US 10,396,485 B1
(45) Date of Patent: Aug. 27, 2019

(54) ELECTRICAL CONNECTOR ASSEMBLY

(71) Applicant: Delphi Technologies, LLC, Troy, MI (US)

(72) Inventors: Eric J. Smoll, Fontana, CA (US); Bao Q. Le, Santa Ana, CA (US); Scott P. Cohen, Corona, CA (US); Gerald A. Rhinehart, Jr., Lordstown, OH (US)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/946,289

(22) Filed: Apr. 5, 2018

(51) Int. Cl.
*H01R 13/41* (2006.01)
*H01R 43/20* (2006.01)
*H01R 13/447* (2006.01)
*H01R 13/422* (2006.01)

(52) U.S. Cl.
CPC ..... *H01R 13/41* (2013.01); *H01R 13/447* (2013.01); *H01R 43/20* (2013.01); *H01R 13/4226* (2013.01)

(58) Field of Classification Search
USPC ..... 439/595
See application file for complete search history.

(56) References Cited

U.S. PATENT DOCUMENTS 3,165,369 A * 1/1965 Maston ..... H01R 13/424 439/380
3,390,376 A * 6/1968 Nava ..... H01R 13/426 439/871
3,824,681 A * 7/1974 Clark ..... B60G 15/02 29/434
3,892,458 A * 7/1975 Clark ..... H01R 13/623 439/319
3,971,613 A * 7/1976 Kobler ..... D06P 1/667 439/595
4,072,383 A * 2/1978 Cameron ..... H01R 13/516 439/598
4,082,398 A * 4/1978 Bourdon ..... H01R 13/4226 439/595
4,358,179 A * 11/1982 Bourdon ..... H01R 13/4226 439/595
4,386,816 A * 6/1983 Frear ..... H01R 13/424 439/595
4,406,507 A * 9/1983 Eifler ..... H01R 13/424 439/595

(Continued)

*Primary Examiner* — Ross N Gushi
(74) *Attorney, Agent, or Firm* — Robert J. Myers

(57) ABSTRACT

An electrical connector assembly includes a connector body having a plurality of terminal receiving cavities formed therein and a plurality of flexible retaining arms integrally formed with a cavity wall and projecting from the cavity wall into the terminal receiving cavity toward a centerline of the terminal receiving cavity. The retaining arm defining a lock surface extending from a first free end of the retaining arm in a direction toward the centerline of the terminal receiving cavity. The assembly also includes a plurality of terminals having an end configured to connect with a corresponding mating terminal and a second end configured to be secured to a wire. The end defines a lock edge. The terminal is received in the terminal receiving cavity such that the first lock surface and the second lock surface engages the lock edge, thereby inhibiting the terminal from being withdrawn from the terminal receiving cavity.

16 Claims, 6 Drawing Sheets

(56) References Cited

U.S. PATENT DOCUMENTS 4,443,048 A * 4/1984 Moist, Jr. ..... H01R 43/20
439/599
4,749,373 A * 6/1988 Brekosky ..... H01R 13/424
439/594
6,086,419 A * 7/2000 Marpoe, Jr. ..... H01R 13/4226
439/595
6,149,472 A * 11/2000 Endo ..... H01R 13/4226
439/745

* cited by examiner

ELECTRICAL CONNECTOR ASSEMBLY

TECHNICAL FIELD OF THE INVENTION

The invention generally relates to an electrical connector assembly, particularly an electrical connector assembly preferably formed using an additive manufacturing process.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Presented herein is an electrical connector assembly that includes a connector body having a terminal receiving cavity formed therein. The terminal receiving cavity is defined by a cavity wall. The electrical connector assembly also includes a first flexible retaining arm in the form of a first cantilevered beam. The first retaining arm is integrally formed with the wall and projects from the cavity wall into the terminal receiving cavity toward a centerline of the terminal receiving cavity. The first retaining arm defines a first lock surface that extends from a first free end of the first retaining arm in a first direction toward the centerline of the terminal receiving cavity. The electrical connector assembly further includes a second flexible retaining arm in the form of a second cantilevered beam that is integrally formed with the cavity wall and projects from another location on the cavity wall opposite the first retaining arm into the terminal receiving cavity. The second retaining arm extends in a second direction angled toward the centerline of the terminal receiving cavity. The second retaining arm defines a second lock surface that extends from a second free end of the second retaining arm toward the centerline of the terminal receiving cavity and the first lock surface. The electrical connector assembly additionally includes a terminal having a first end that is configured to interconnect with a corresponding mating terminal and a second end configured to be secured to a wire. The first end of the terminal defines a lock edge. The terminal is received in the terminal receiving cavity such that the first lock surface and the second lock surface engages the lock edge, thereby inhibiting the terminal from being withdrawn from the terminal receiving cavity.

Figure 1:
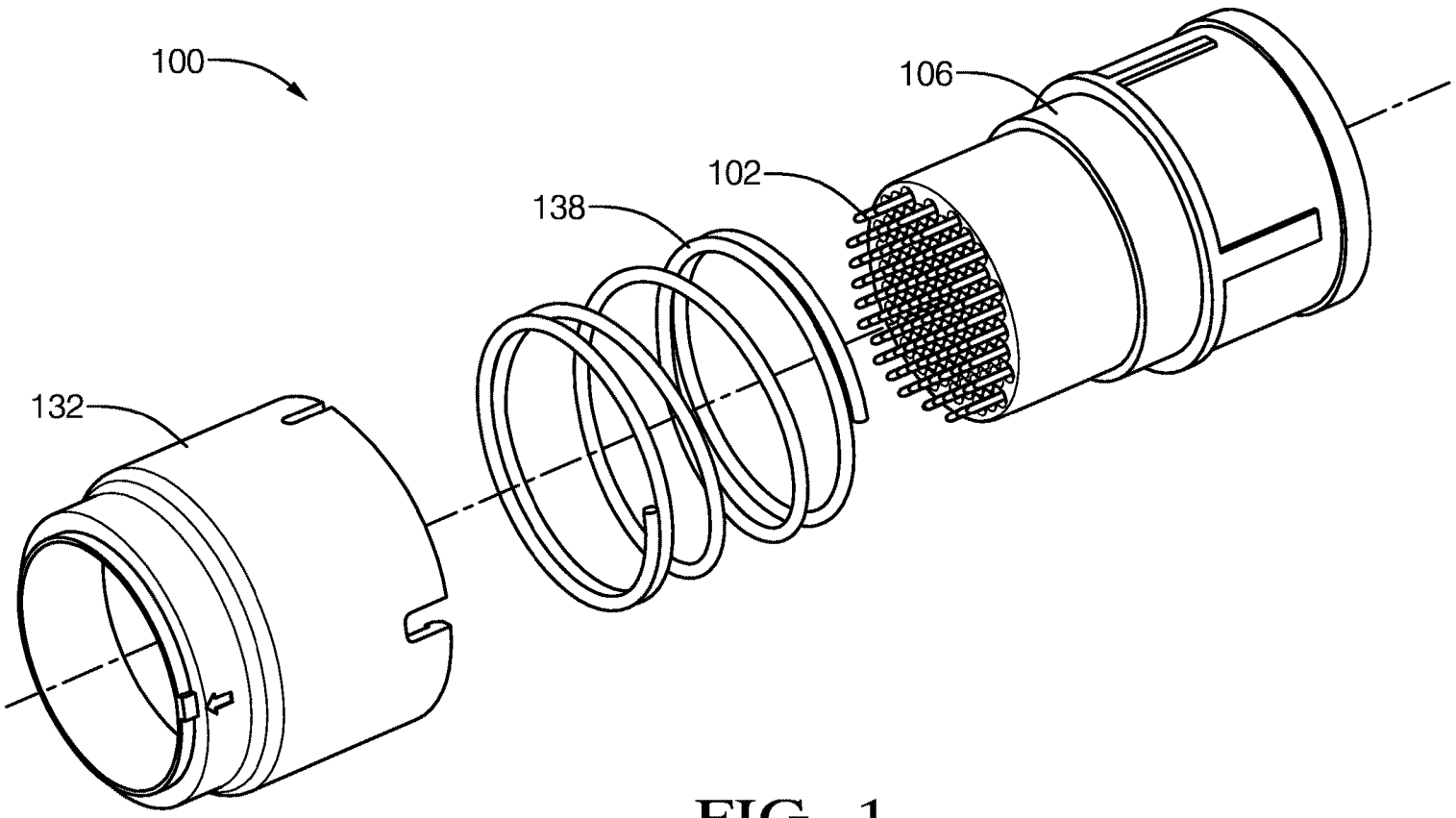
FIG. 1 is an exploded perspective view of an electrical conductor assembly including a retractable shroud according to one embodiment.

FIGS. 1-8 illustrate a non-limiting example of an electrical connector assembly 100, hereinafter referred to as the assembly 100. The illustrated example is a plug connector assembly adapted to shipboard electrical connections conforming to U.S. military specification MIL-DTL-28840 that is used as a test plug for verifying proper operation of various receptacle connector assemblies also conforming to specification MIL-DTL-28840. As shown in FIG. 1, the assembly 100 includes an array of male pin terminals 102, hereinafter referred to as the terminals or terminal 102, that are received and retained within a plurality of terminal receiving cavities 104, hereafter referred to as the cavities or cavity 104, defined within a connector body 106. Each terminal 102 has a first end 108 that is configured to interconnect with a corresponding female socket terminal (not shown) contained in a receptacle connector assembly (not shown). Each terminal 102 also has a second end 110 that is secured to a wire cable (not shown). The terminals 102 are formed of an electrically conductive material, such as a plated copper alloy.

Figure 2:
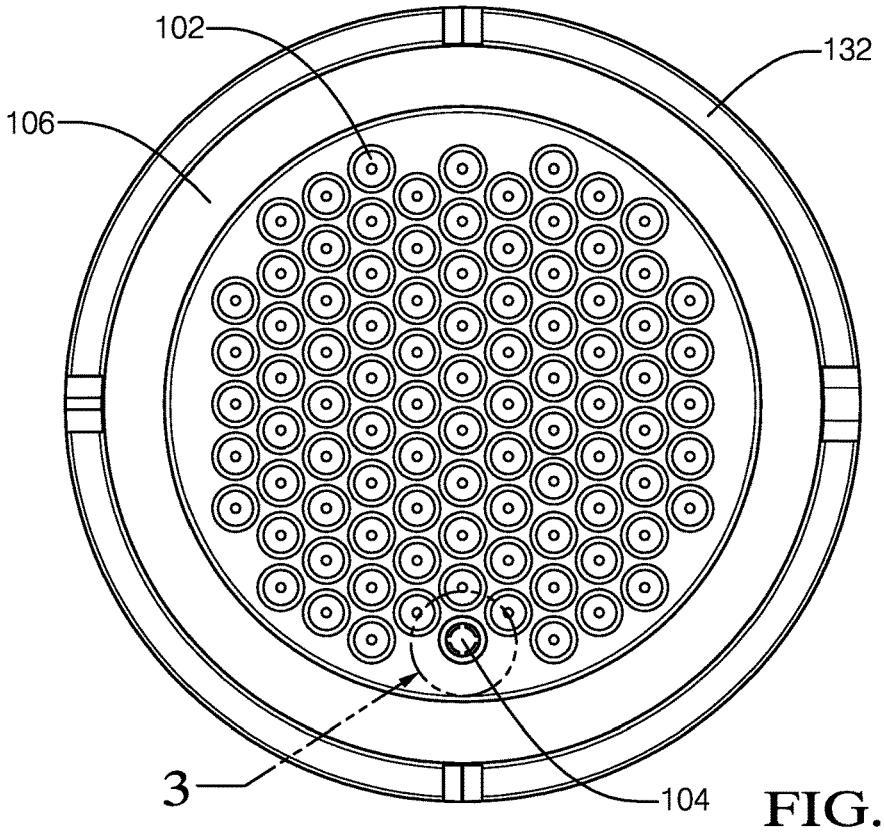
FIG. 2 is an end view of the electrical conductor assembly of FIG. 1 according to one embodiment.
Figure 3:
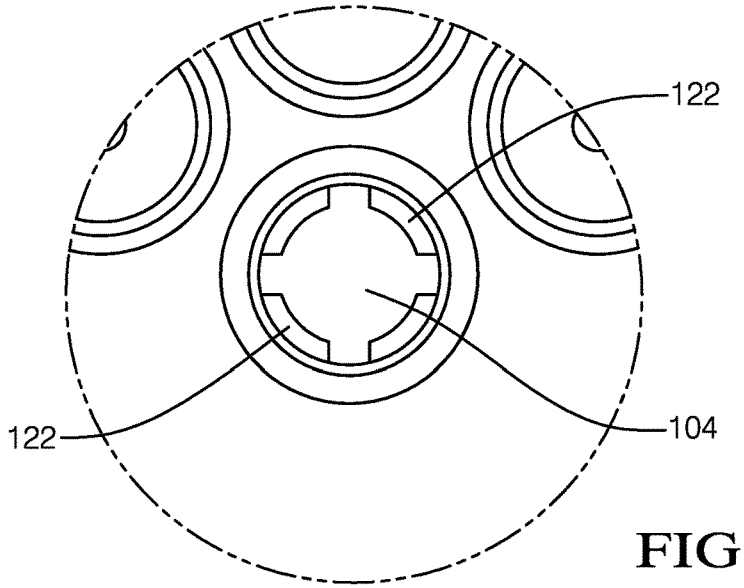
FIG. 3 is a close up end view of an empty cavity in the electrical conductor assembly of FIG. 1 according to one embodiment.
Figure 4:
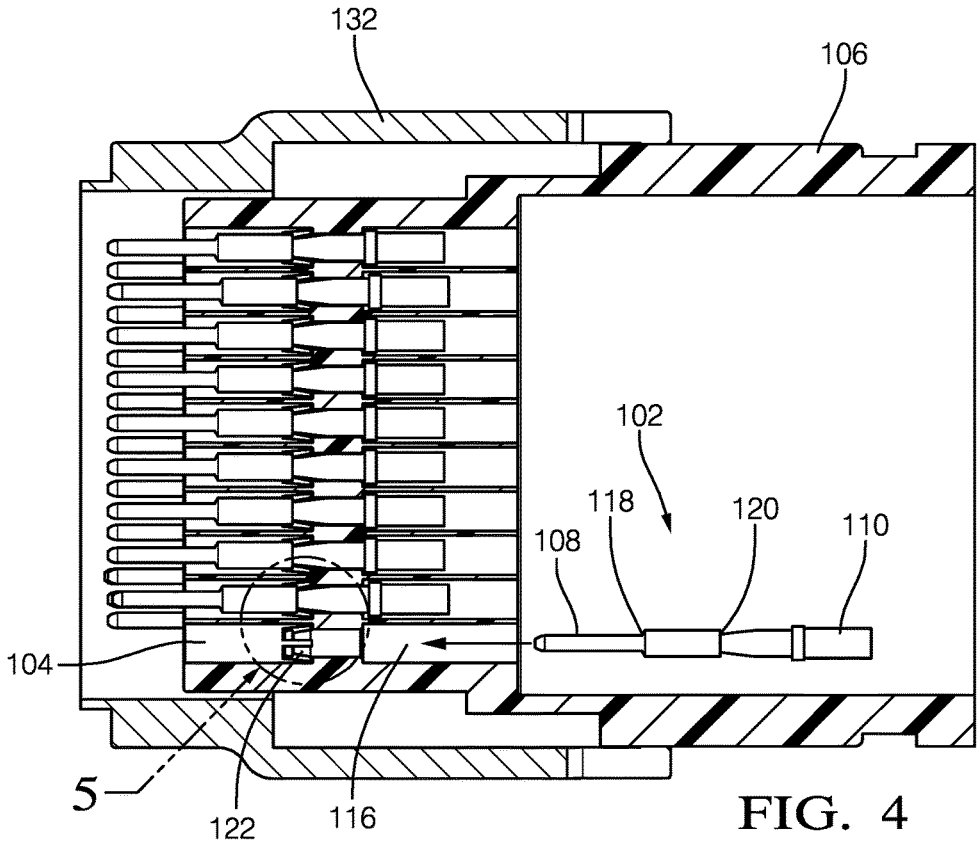
FIG. 4 is a cross section view of the electrical conductor assembly of FIG. 1 according to one embodiment.
Figure 5:
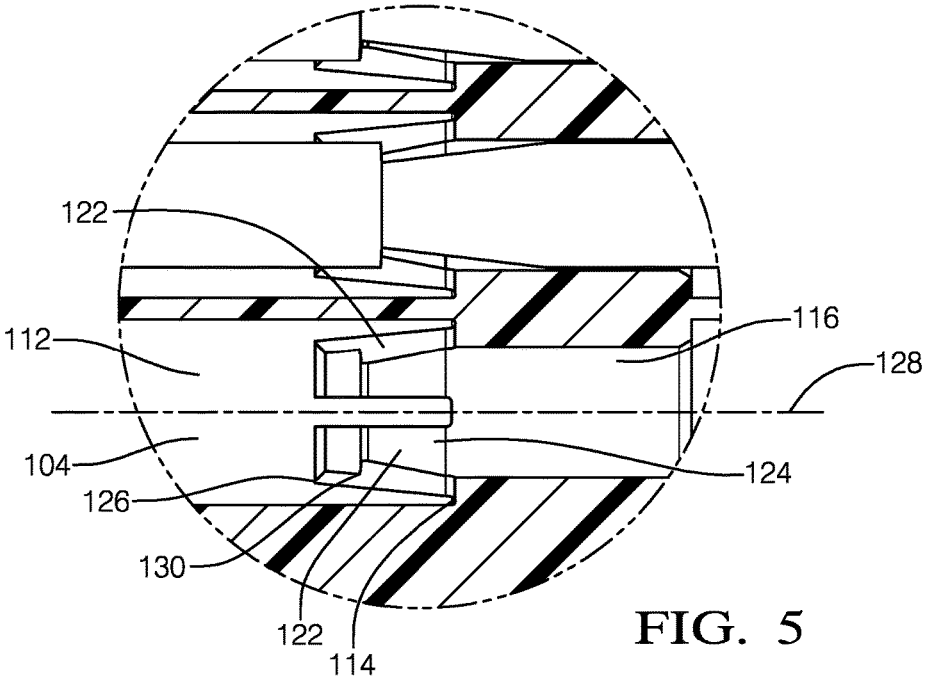
FIG. 5 is a close up front cross section view of the electrical conductor assembly of FIG. 1 according to one embodiment.

As illustrated in FIGS. 2 and 3, each of the cavities 104 is generally cylindrical having a cavity side wall 112 defining the cavity 104. As shown in FIGS. 4 and 5 a cavity end wall 114 defines a passage 116 through which the terminal 102 is inserted into the cavity 104. The second end 110 of the terminal 102 defines a forward lock ridge 118 extending circumferentially around the terminal 102 and a rearward lock ridge 120 also extending circumferentially around the terminal 102. The diameter of the rearward lock ridge 120 is greater than the diameter of the passage 116, thereby inhibiting further forward movement of the terminal 102 into the cavity 104. Each cavity 104 has at least one opposed pair of flexible retaining arms 122 that engage the forward lock ridge 118 of the terminal 102 to releasably retain the terminal 102 within the cavity 104. As illustrated in FIGS. 4 and 5, each of the retaining arms 122 is in the form of a cantilevered beam having a fixed end 124 attached to the cavity end wall 114 and a free end 126 terminating the retaining arm 122 as it projects from the cavity end wall 114 toward the centerline 128 of the cavity 104.

The retaining arm 122 defines a lock surface 130 that is oriented generally perpendicularly to the centerline 128 of the cavity 104. The lock surface 130 is configured to engage the forward lock ridge 118 of the terminal 102, thereby inhibiting rearward movement of the terminal 102 from the cavity 104 once the lock surface 130 of the retaining arm 122 has engaged the forward lock ridge 118, thereby retaining the position of the terminal 102 within the cavity 104.

Each retaining arm 122 is integrally formed with the connector body 106. The connector body 106 is formed of a dielectric polymeric material by a computer controlled additive manufacturing process, such as stereolithography, digital light processing, fused deposition modeling, fused filament fabrication, selective laser sintering, selecting heat sintering, multi-jet modeling, multi-jet fusion, electronic beam melting, laminated object manufacturing, or other additive manufacturing technologies generally referred to as 3D printing. The retaining arms 122 may easily be formed with square corners through the use of any of the additive manufacturing processes listed above, which is not easily accomplished using other manufacturing methods, e.g. injection molding or machining.

Figure 6:
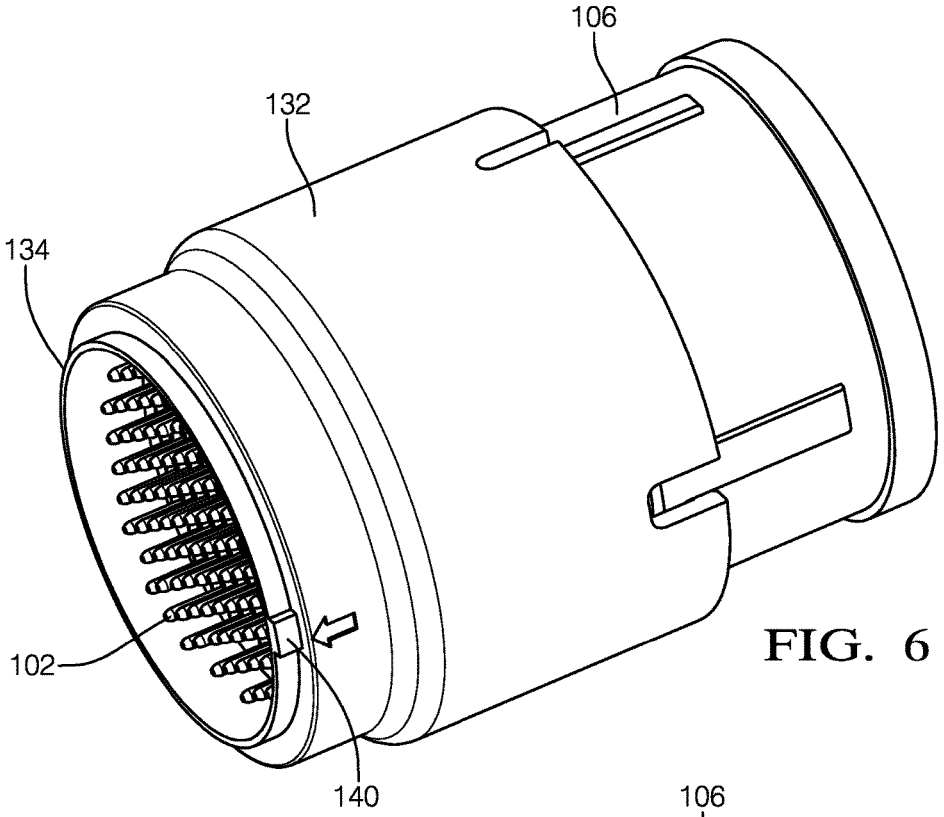
FIG. 6 is a perspective view of the electrical conductor assembly of FIG. 1 with the retractable shroud in an extended position according to one embodiment.
Figure 7:
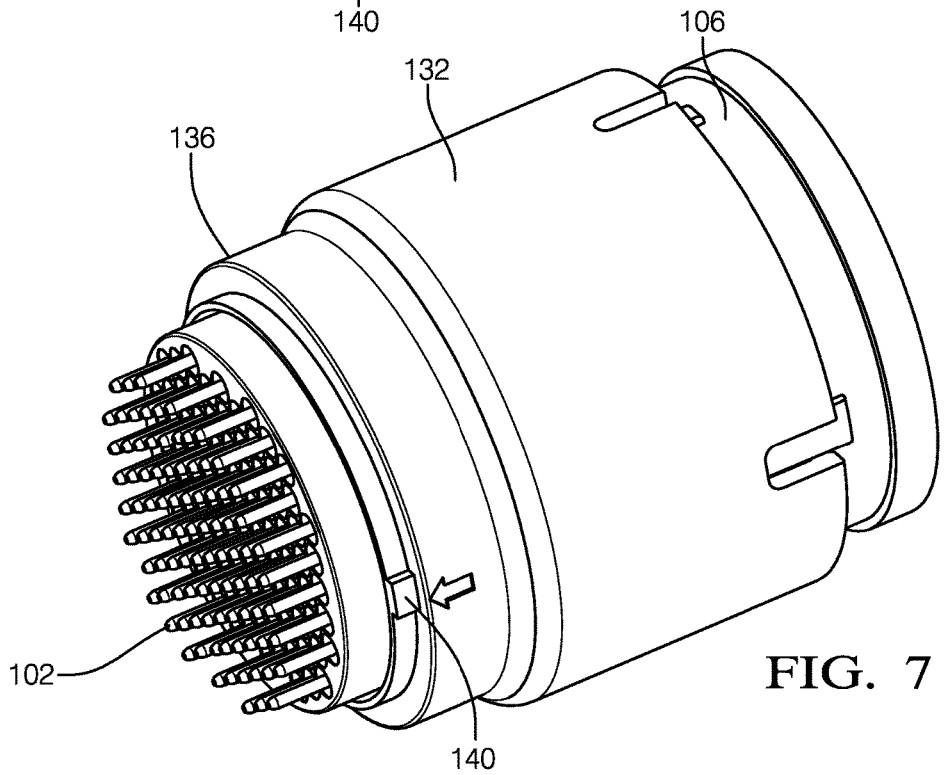
FIG. 7 is a perspective view of the electrical conductor assembly of FIG. 1 with the retractable shroud in a retracted position according to one embodiment.

As illustrated in FIGS. 6 and 7, the assembly 100 further comprises a retractable shroud 132, hereinafter referred to as the shroud 132, that is slideably attached to the connector body 106 and is moveable from an extended position 134 shown in FIG. 6 in which a portion of the shroud 132 extends beyond the tips of the array of terminals 102 to a retracted position 136 shown in FIG. 7 in which the segment of the array of terminals 102 protrudes beyond the shroud 132. The shroud 132 is also preferably formed by an additive manufacturing process, such as stereolithography, digital light processing, fused deposition modeling, fused filament fabrication, selective laser sintering, selecting heat sintering, multi-jet modeling, multi-jet fusion, electronic beam melting, laminated object manufacturing, or other additive manufacturing technologies generally referred to as 3D printing. The shroud 132 may be integrally formed using the same additive manufacturing process as used to form the connector body 106. The shroud 132 may be formed of a dielectric polymeric material. In alternative embodiments, the shroud 132 may be formed of a conductive metallic material. The assembly 100 includes a biasing means 138, e.g. a helical spring, that is configured to maintain the shroud 132 in the extended position 134.

The shroud 132 defines a single main polarizing key 140 that received within the main polarizing keyway of the corresponding receptacle connector assemblies. The main polarizing key 140 is common to all polarizing key configurations for specification MIL-DTL-28840. The shroud 132 does not define any secondary polarizing keys. This allows the assembly 100 to be used with any receptacle connector conforming to specification MIL-DTL-28840 regardless of the secondary polarizing keyway configuration. The polarizing key 140 may easily be formed with square corners through the use of any of the additive manufacturing processes listed above, which is not easily accomplished using other manufacturing methods, e.g. injection molding or machining. Further, the polarizing key 140 can be formed without a draft angle, thereby providing tighter tolerances than could be obtained using injection molding.

Figure 8:
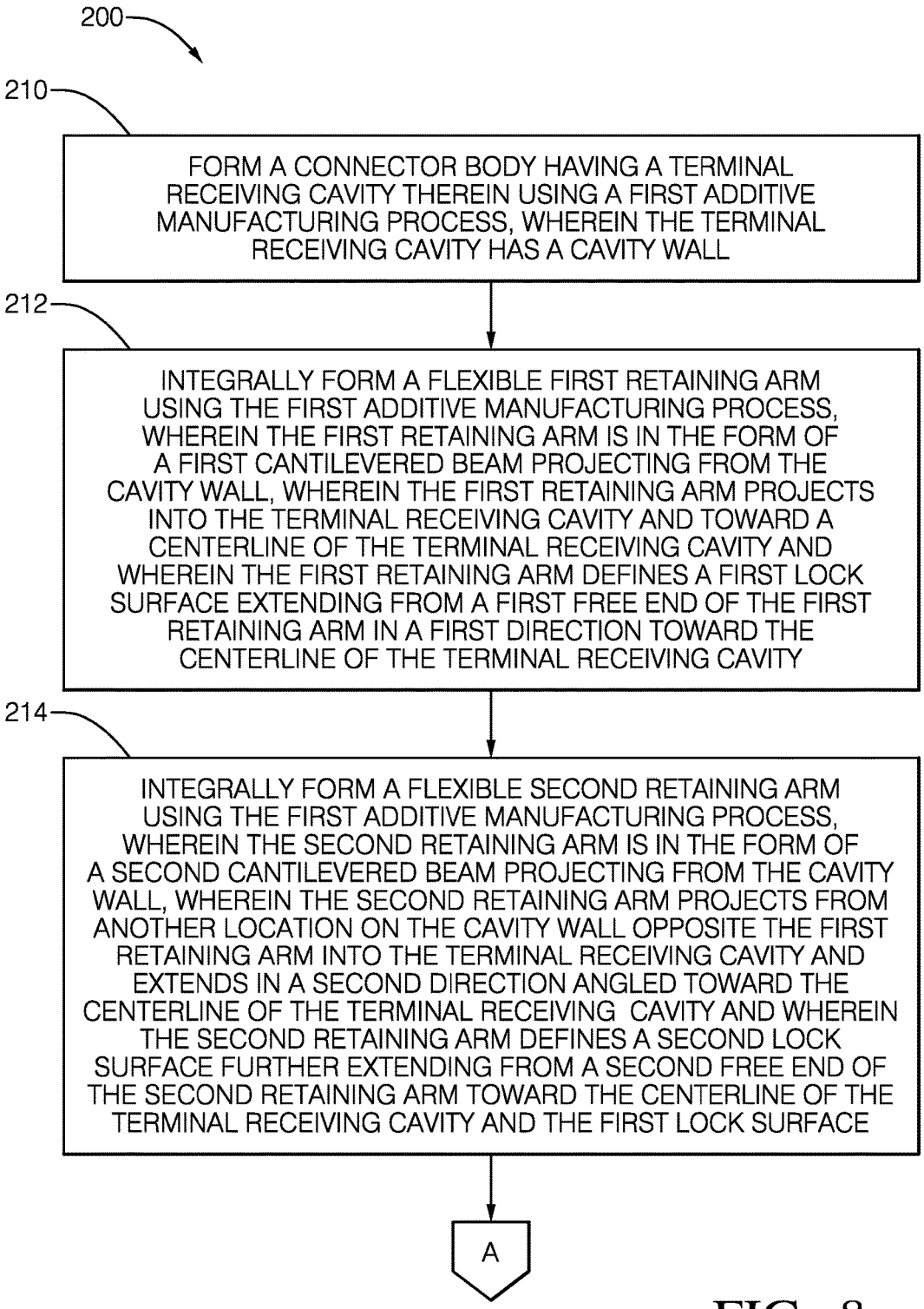
FIG. 8 is a flow chart of a method of manufacturing the of the electrical conductor assembly of FIG. 1 according to another embodiment.
Figure 8:
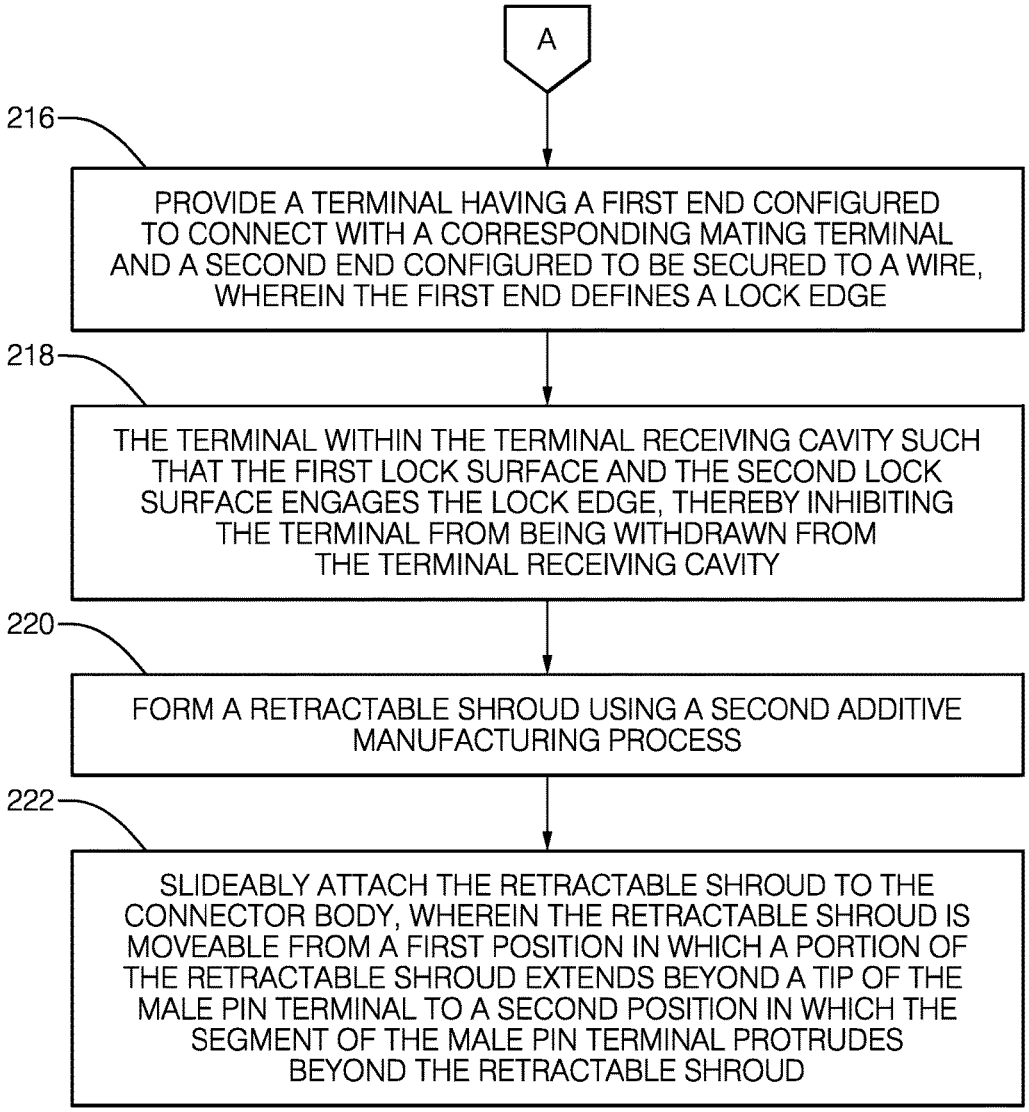

FIG. 8 describes a method 200 of manufacturing the assembly 100 described above. The method 200 includes the following steps:

STEP 210, FORMING A CONNECTOR BODY, includes forming a connector body 106 having a cavity 104 formed therein using an additive manufacturing process, such as stereolithography, digital light processing, fused deposition modeling, fused filament fabrication, selective laser sintering, selecting heat sintering, multi-jet modeling, multi-jet fusion, electronic beam melting, laminated object manufacturing, or other additive manufacturing technologies generally referred to as 3D printing. The cavity 104 is defined by a cavity wall;

STEP 212, FORM A FIRST RETAINING ARM, includes integrally forming a flexible first retaining arm 122 using the additive manufacturing process. The first retaining arm 122 is in the form of a first cantilevered beam projecting from the cavity wall. The first retaining arm 122 projects into the cavity 104 and toward a centerline 128 of the cavity 104. The first retaining arm 122 defines first lock surface 130 oriented generally perpendicularly to the centerline 128 of the cavity 104. The first lock surface 130 is configured to engage the forward lock edge of the terminal 102;

STEP 214, FORM A SECOND RETAINING ARM, includes integrally forming a flexible second retaining arm 122 using the additive manufacturing process. The second retaining arm 122 is in the form of a second cantilevered beam projecting from the cavity wall. The second retaining arm 122 projects from another location on the cavity 104 opposite the first retaining arm 122 into the cavity 104 and extends in a second direction angled toward the centerline 128 of the cavity 104. The second retaining arm 122 defines a second lock surface 130 oriented generally perpendicularly to the centerline 128 of the cavity 104. The second lock surface 130 is also configured to engage the forward lock edge of the terminal 102;

STEP 216, PROVIDE A TERMINAL, includes providing a terminal 102 having a first end 108 configured to connect with a corresponding mating terminal and a second end 110 configured to be secured to a wire. The first end 108 defines a lock edge;

STEP 218, DISPOSE A TERMINAL WITHIN A TERMINAL RECEIVING CAVITY, includes disposing the terminal 102 within the cavity 104 such that the first lock surface 130 and the second lock surface 130 engages the forward lock ridge 118, thereby inhibiting the terminal 102 from being withdrawn from the cavity 104;

STEP 220, FORM A RETRACTABLE SHROUD, includes forming a retractable shroud 132 using another additive manufacturing process, such as stereolithography, digital light processing, fused deposition modeling, fused filament fabrication, selective laser sintering, selecting heat sintering, multi-jet modeling, multi-jet fusion, electronic beam melting, laminated object manufacturing, or other additive manufacturing technologies generally referred to as 3D printing. This additive manufacturing process may be the same additive manufacturing process used to form the connector body 106, or it may be a different additive manufacturing process. The shroud 132 defines a single main polarizing key 140 that is common to all polarizing key configurations without any other polarizing keys; and STEP 222, ATTACH THE RETRACTABLE SHROUD TO THE CONNECTOR BODY, includes slideably attaching the shroud 132 to the connector body 106, wherein the shroud 132 is moveable from a first position in which a portion of the shroud 132 extends beyond a tip of the terminal 102 to a second position in which the segment of the terminal 102 protrudes beyond the shroud 132.

Accordingly, an electrical connector assembly 100 is provided. The assembly 100 includes retaining arms 122 that are integrally formed with the connector body 106 that are configured to retain the terminals 102 within the cavities 104, thereby eliminating separate terminal retainers that were required in prior designs, providing the benefit of a reduced number of assembly steps, fewer parts, resulting in reduced assembly cost and reduced assembly time. The assembly 100 also includes a retractable shroud 132 that provides the benefit of protecting the terminals 102 when the electrical connector assembly 100 is not engaged with a corresponding receptacle connector. The shroud 132 includes a single polarizing key, allowing the electrical connector assembly 100 to be used with any configuration of secondary keyways on the corresponding receptacle connector.

The example presented herein is directed to a plug connector conforming to specification MIL-DTL-28840, alternative embodiments may be plug connectors using conforming to different connector specification or may even be receptacle connectors.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. Moreover, the use of the terms first, second, etc. does not denote any order of importance, but rather the terms first, second, etc. are used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, directional terms such as upper, lower, etc. do not denote any particular orientation, but rather the terms upper, lower, etc. are used to distinguish one element from another and establish a relationship between the various elements.

We claim:

1. An electrical connector assembly, comprising:

a connector body having a terminal receiving cavity formed therein, the terminal receiving cavity having a cavity wall;

a flexible first retaining arm in the form of a first cantilevered beam integrally formed with the cavity wall and projecting from the cavity wall into the terminal receiving cavity toward a centerline of the terminal receiving cavity, said first retaining arm defining a first lock surface extending from a first free end of the first retaining arm in a first direction angled toward the centerline of the terminal receiving cavity;

a flexible second retaining arm in the form of a second cantilevered beam integrally formed with the cavity wall and projecting from another location on the cavity wall opposite the first retaining arm into the terminal receiving cavity and extending in a second direction angled toward the centerline of the terminal receiving cavity, said second retaining arm defining a second lock surface further extending from a second free end of the second retaining arm toward the centerline of the terminal receiving cavity and the first lock surface;

a male pin terminal having a segment protruding from the connector body, a first end configured to connect with a corresponding mating terminal, and a second end configured to be secured to a wire, said first end defining a lock edge, wherein the terminal is received in the terminal receiving cavity such that the first lock surface and the second lock surface engages the lock edge, thereby inhibiting the terminal from being withdrawn from the terminal receiving cavity; and a retractable shroud slideably attached to the connector body and moveable from a first position in which a portion of the retractable shroud extends beyond a tip of the male pin terminal to a second position in which the segment of the male pin terminal protrudes beyond the retractable shroud.

2. The electrical connector assembly according to claim 1, wherein the connector body is formed by an additive manufacturing process.

3. The electrical connector assembly according to claim 2, wherein the additive manufacturing process is selected from a list consisting of stereolithography, digital light processing, fused deposition modeling, fused filament fabrication, selective laser sintering, selecting heat sintering, multi-jet modeling, multi-jet fusion, electronic beam melting, laminated object manufacturing, and 3D printing.

4. The electrical connector assembly according to claim 1, wherein the retractable shroud is formed by an additive manufacturing process.

5. The electrical connector assembly according to claim 4, wherein the additive manufacturing process is selected from a list consisting of stereolithography, digital light processing, fused deposition modeling, fused filament fabrication, selective laser sintering, selecting heat sintering, multi-jet modeling, multi-jet fusion, electronic beam melting, laminated object manufacturing, and 3D printing.

6. The electrical connector assembly according to claim 1, wherein the electrical connector assembly conforms to specification MIL-DTL-28840.

7. The electrical connector assembly according to claim 6, wherein the retractable shroud defines a single main polarizing key common to all polarizing key configurations without any other polarizing keys.

8. The electrical connector assembly according to claim 1, wherein the first lock surface is oriented generally perpendicularly to the centerline and wherein the second lock surface is oriented generally perpendicularly to the centerline.

9. The electrical connector assembly according to claim 8, wherein the connector body defines a plurality of terminal receiving cavities and wherein each terminal receiving cavity in the plurality of terminal receiving cavities contains one terminal of a plurality of terminals.

10. An electrical connector assembly, manufactured by a process comprising the steps of:

forming a connector body having a terminal receiving cavity therein defining a cavity wall;

integrally forming a flexible first retaining arm, wherein the first retaining arm is in the form of a first cantilevered beam projecting from the cavity wall, wherein the first retaining arm projects into the terminal receiving cavity and toward a centerline of the terminal receiving cavity and wherein the first retaining arm defines a first lock surface extending from a first free end of the first retaining arm in a first direction toward the centerline of the terminal receiving cavity;

integrally forming a flexible second retaining arm, wherein the second retaining arm is in the form of a second cantilevered beam projecting from the cavity wall, wherein the second retaining arm projects from another location on the cavity wall opposite the first retaining arm into the terminal receiving cavity and extends in a second direction angled toward the centerline of the terminal receiving cavity and wherein the second retaining arm defines a second lock surface further extending from a second free end of the second retaining arm toward the centerline of the terminal receiving cavity and the first lock surface;

providing a male pin terminal having a segment protruding from the connector body, a first end configured to connect with a corresponding mating terminal and a second end configured to be secured to a wire, wherein the first end defines a lock edge;

disposing the terminal within the terminal receiving cavity such that the first lock surface and the second lock surface engages the lock edge, thereby inhibiting the terminal from being withdrawn from the terminal receiving cavity;

forming a retractable shroud, and slideably attaching the retractable shroud to the connector body, wherein the retractable shroud is moveable from a first position in which a portion of the retractable shroud extends beyond a tip of the male pin terminal to a second position in which the segment of the male pin terminal protrudes beyond the retractable shroud.

11. The electrical connector assembly according to claim 10, wherein the connector body, first retaining arm, and second retaining arm are formed by a first additive manufacturing process selected from a list consisting of stereolithography, digital light processing, fused deposition modeling, fused filament fabrication, selective laser sintering, selecting heat sintering, multi-jet modeling, multi-jet fusion, electronic beam melting, laminated object manufacturing, and 3D printing.

12. The electrical connector assembly according to claim 10, wherein the retractable shroud is formed by a second additive manufacturing process selected from a list consisting of stereolithography, digital light processing, fused deposition modeling, fused filament fabrication, selective laser sintering, selecting heat sintering, multi-jet modeling, multi-jet fusion, electronic beam melting, laminated object manufacturing, and 3D printing.

13. The electrical connector assembly according to claim 10, wherein the electrical connector assembly conforms to specification MIL-DTL-28840.

14. The electrical connector assembly according to claim 13, wherein the connector body defines a single main polarizing key common to all polarizing key configurations without any other polarizing keys.

15. The electrical connector assembly according to claim 10, wherein the first lock surface is oriented generally perpendicularly to the centerline and wherein the second lock surface is oriented generally perpendicularly to the centerline.

16. The electrical connector assembly according to claim 10, wherein the connector body defines a plurality of terminal receiving cavities and wherein each terminal receiving cavity in the plurality of terminal receiving cavities contains one terminal of a plurality of terminals.

* * * * *